United States Patent [19]

Oppenhuizen

[11] Patent Number: 4,905,334

[45] Date of Patent: Mar. 6, 1990

[54] REFURBISHING PANEL SYSTEM FOR SPACE DIVIDER PARTITION WALLS

[76] Inventor: Donald E. Oppenhuizen, 8022 Kraft, Caledonia, Mich. 49316

[21] Appl. No.: 370,504

[22] Filed: Jun. 23, 1989

[51] Int. Cl.[4] ..... E04B 1/38

[52] U.S. Cl. ..... 52/511; 52/823; 52/656

[58] Field of Search ..... 52/511, 506, 813, 823, 52/656

[56] References Cited

U.S. PATENT DOCUMENTS

| | | | |
|---|---|---|---|
| 3,328,927 | 7/1967 | Kates | 52/511 X |
| 3,374,597 | 3/1968 | Whitener | 52/656 X |
| 3,479,770 | 11/1969 | Mock | 52/823 X |
| 3,608,266 | 9/1971 | Satkin et al. | 52/511 X |
| 4,570,406 | 2/1986 | DiFazio | 52/656 |
| 4,704,835 | 11/1987 | Jordan | 52/571 X |
| 4,731,972 | 3/1988 | Anderson | 52/506 X |

*Primary Examiner*—Carl D. Friedman

*Attorney, Agent, or Firm*—Sughrue, Mion, Zinn, Macpeak & Seas

[57] ABSTRACT

A refurbishing panel assembly for face attachment to an existing space divider partition wall is formed of an open rectangular frame defined by oppositely facing mirror image lightweight plastic extrusions and coupled together at right angles by lightweight molded plastic corner blocks. The extrusions are of identical cross-section, including a flat rear wall, an outer, flat parallel front wall integrally joined to the rear wall by a right angle inner end wall. An integral outer end wall extends obliquely from the rear wall away from the inner end wall and connects to the front wall and defines therewith a trapazoidal shaped cavity. The front and rear walls of the extrusions have free ends extending beyond the inner end wall and form an inner peripheral groove for receiving a rectangular plan configured board sized to the open frame and having peripheral edges captured within the grooves of the extrusions. A fabric sheet covers the front face of the board and has peripheral edges wrapped about the oblique outer wall of the extrusions and is fixed to the rear wall of the extrusions forming a lightweight refurbishing panel with obliquely tapered edges about the four sides thereof. Plastic extruded hangers include hooks projectable through openings in the partition wall for commonly supporting a number of refurbishing panels in an assembly in facing contact with and overlying a flat surface of the space divider partition wall.

15 Claims, 3 Drawing Sheets

FIG.3
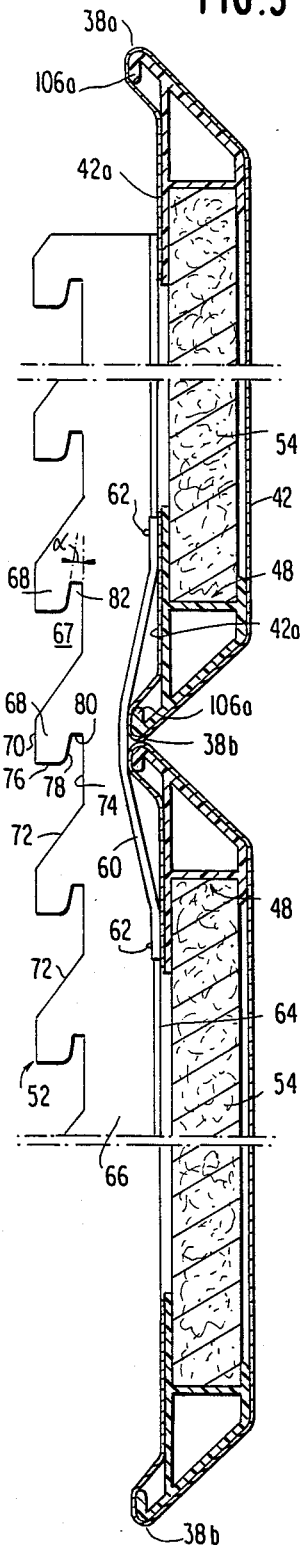
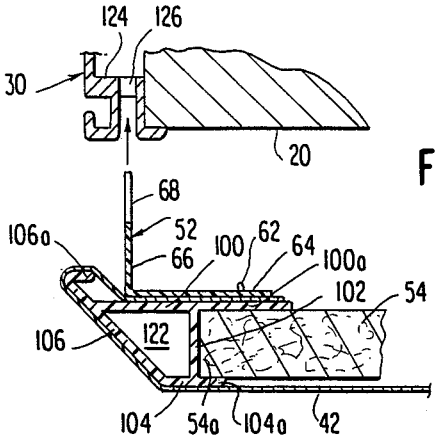
FIG.4
FIG.5
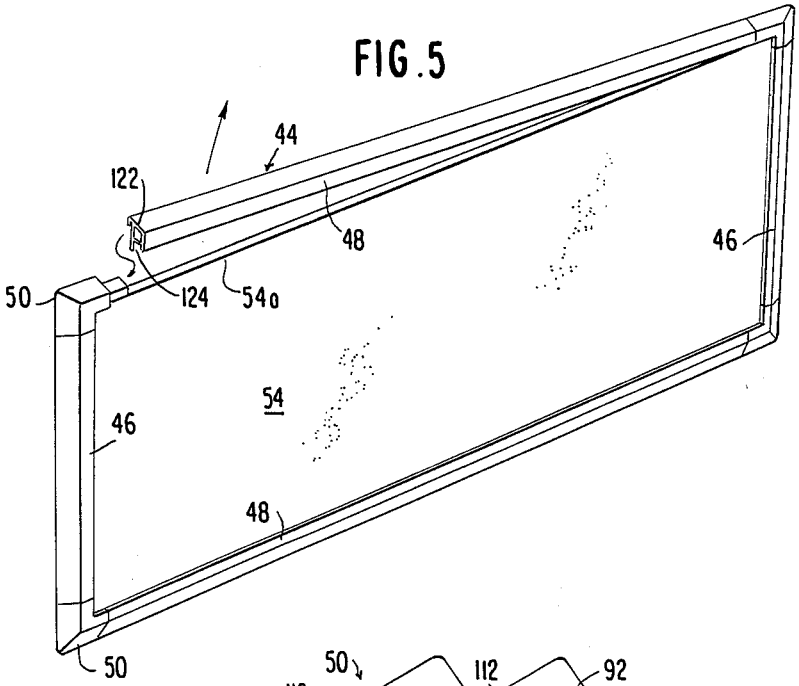
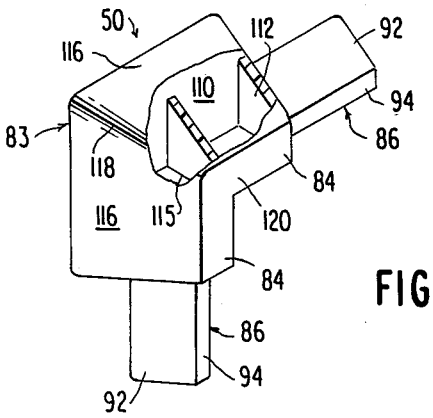
FIG.6

FIG.7
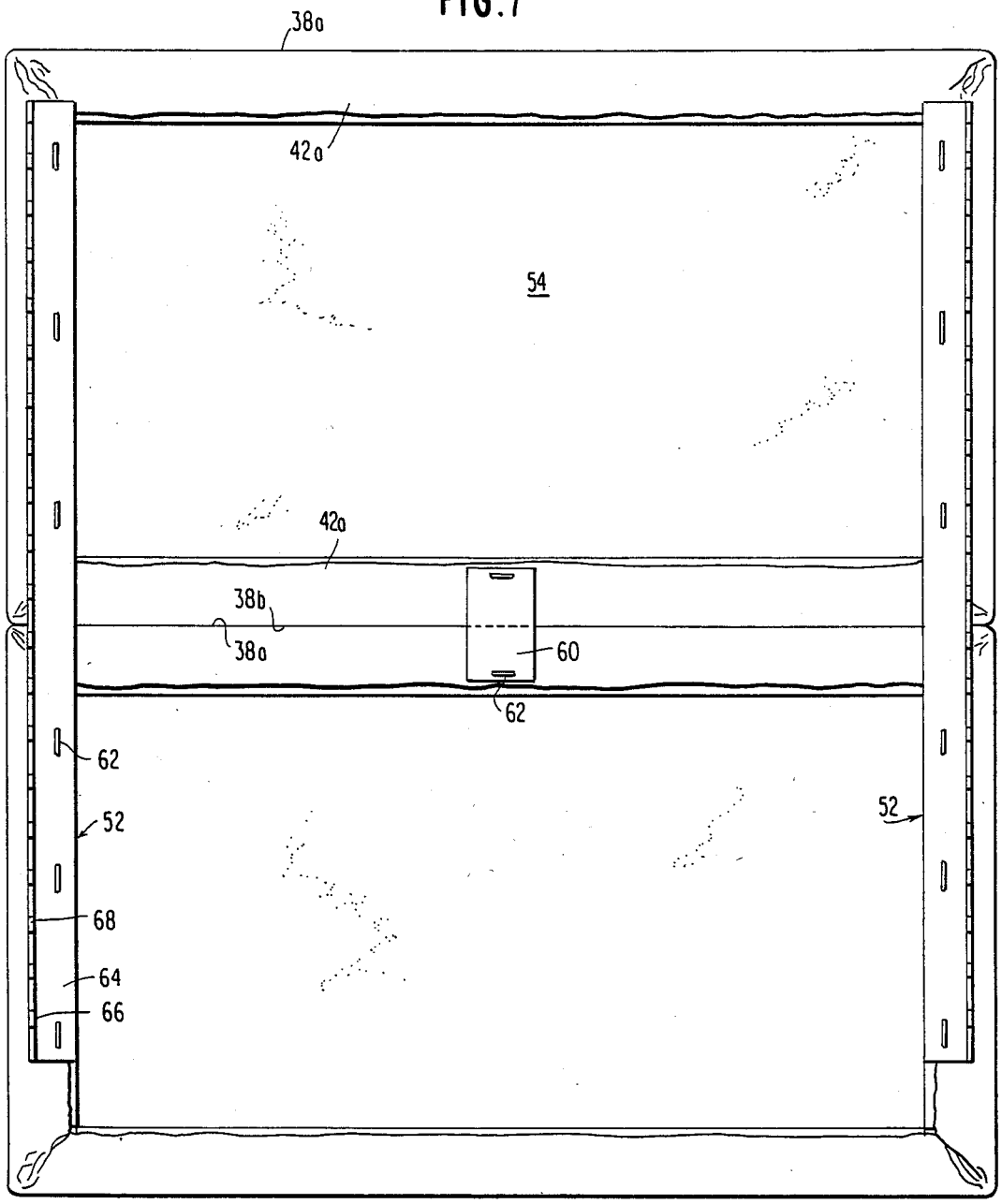
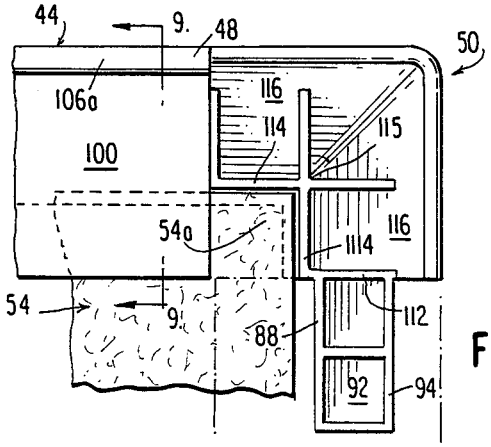
FIG.8
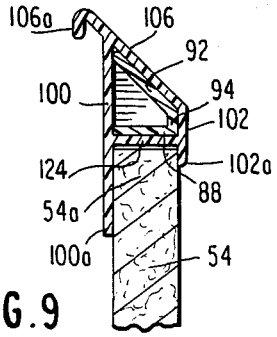
FIG.9

REFURBISHING PANEL SYSTEM FOR SPACE DIVIDER PARTITION WALLS

FIELD OF THE INVENTION

This invention relates to space divider partition systems for modular office furniture arrangements and more particularly to a refurbishing panel system for mounting directly to the vertical divider partitions forming space divider walls.

Conventional space divider partition systems utilize a plurality of partition panels or panel assemblies connected end-to-end or intersecting each other at various angles to divide an office area as desired. Typically the individual panels for the space divider partition system include vertical grooves within the panels or at the area of junction between panels with a plurality of spaced narrow vertical slots within hanger supports Hanger brackets have engaging hooks inserted within respective slots so that desks, storage cabinets, shelves and the like may be fixedly but removably secured to panels.

The individual panel assemblies forming the space divider partitions normally employ particle boards of rectangular form supported by frames, with the outer surface of the particle board covered by a decorative fabric. In known space divider partition systems, such panel assemblies are supported, at opposite lateral ends, by channel members or the like forming vertical end pieces. The end pieces are provided within vertical front and rear walls thereof, vertically elongated slots for receiving hooks of the hanger brackets which hang the work surfaces or cabinets on the panel assemblies. Typically, decorative end covers attach to the channel members. Further, top and bottom trim pieces overlie and underlie respectively the panel or panel assembly. These may be formed of metal wood or the like, and constitute an exterior decorative framing for the vertical partition walls formed of a plurality of modular panels or panel assemblies. The trim pieces contrast and compliment the fabric covering the individual panels of the space divider partition walls.

Such construction is complicated by the necessity to carry electrical cables within the space divider partition walls, and to make appropriate electrical connections between the various panels making up the partition for a given wall.

Over years of use, such space divider partition walls are abused. The fabric covering of the panels may be torn, soiled, or both requiring panel or at least fabric replacement. To date there is no satisfactory arrangement for replacing soiled damaged panels or the fabric covering the same. Further, the hanger systems for such space divider partition walls are such that in order to remove a lower panel, where panels are stacked one on top of the other, it is necessary to remove the upper panels from the supporting channel members and wall framing components.

It is, therefore, a primary object of the present invention to provide an effective esthetically pleasing refurbishing panel system for existing space divider partition walls which may be readily applied to an existing space divider system without need for complete or partial dismantling of the partition wall components or removing any of the partition wall panels.

It is a further object of the invention to provide a refurbishing panel assembly in which refurbishing panel of modular form, sized to the lateral width of an existing space divider partition wall panel assembly, consisting of a series of stacked, edge-to-edge abutting refurbishing panels mechanically connected at said abutting edges and linked by vertically oriented hanger brackets having a plurality of hooks extending over the vertical length of the panel assembly for coupling the refurbishing panel assembly to an existing hanger support of the space divider partition wall panels at grooves formed therein or therebetween.

It is a further object of the invention to provide an improved hanger bracket for facilitating the hanging and removal of such refurbishing panel assembly having camming surfaces for self-camming of the hooks from the slots of the hanger supports by simple vertical lifting of the multiple refurbishing panels as an assembly, relative to the existing space divider partition walls.

SUMMARY OF THE INVENTION

This invention relates to a refurbishing panel for refurbishing existing space divider partition walls, and to a refurbishing panel assembly for simultaneous attachment to such space divider partition wall panels.

Each refurbishing panel consists of an open rectangular frame defined by horizontal top and bottom extrusions, laterally opposed vertical side extrusions and molded corner blocks coupling respective ends of the extrusions to form said open rectangular frame. The extrusions are identical in cross-section with a flat, rear base, an outer flat parallel front wall integrally joined to the base by a right angle inner end wall, and an outer end wall extending integrally from said front wall at least to said rear wall and obliquely away from the inner end wall. The front and rear walls of the extrusions have free end portions extending beyond the inner end wall to the side remote from the outer end wall forming an inner peripheral groove. A rectangular particle board sized thereto is edge captured within the inner peripheral grooves of said extrusions. A fabric sheet covers the front face of the particle board and has edges about four sides thereof wrapped about the oblique outer wall of the extrusions and fixed to the frame ,rear wall of the extrusions, thereby forming a lightweight refurbishing panel having obliquely tapered edges. The overall width of the refurbishing panel is equal to the lateral width of the space divider partition wall panel to be covered such that when attached to the partition wall, it serves to completely cover the fabric covering of the existing space divider partition wall panel and lie internal of the trim strips thereof.

The refurbishing panel is preferably provided with elongated, vertically extending angle bar hanger brackets fixed to one of the rear wall and an adjacent vertical side extrusion, and extending vertically parallel to the side extrusions of the panel rectangular frame. The angle bar hanger brackets comprise a flat base portion fixed to the rear of the refurbishing panel and an integral right angle leg. A first flat outer edge or surface of the leg remote from the base is serrated to form notches or recesses of modified L-shaped configuration defining a series of longitudinally spaced hooks. The hooks include the flat outer edge or surface parallel to the base, an oblique surface extending inwardly from the flat outer surface, from one hook towards the next, to one side of said outer surface. A right angle hook end face to the opposite side thereof and a second inner flat surface parallel to the first flat outer surface, and extending from the end of said oblique surface from said one hook to beyond said right angle surface of the adjacent hook.

Each hook further includes a second, oblique surface facing said second flat surface, and terminating in a notch end face at right angles to the flat outer edge surface and extending from the second oblique surface, to said second flat surface to define an outwardly diverging groove formed toward the first oblique surface of said panel portion for facilitating frictional lock between the hanger bracket and a hanger support of said existing space divider partition wall at each slot thereof receiving a hook. Said first oblique surface of each hook functions to cam the hanger bracket and the refurbishing panel of said refurbishing panel assembly, outwardly of said existing space divider partition wall grooves permitting demounting of the refurbishing panel assembly therefrom upon lifting of the refurbishing panel assembly vertically upwardly relative to the space divider partition wall.

The open, rectangular frame corner blocks are of generally L-shaped plan configuration, are correspondingly sized to the vertical side and horizontal top and bottom extrusions, have outwardly oblique right angle faces extending from a flat front face thereof toward a rear face thereof. The corner blocks include projecting tenons of complimentary configuration integral therewith, and extending outwardly of right angle opposite end faces of the corner block central section. The corner block tenons are of trapezoidal cross-sectional configuration, and sized to closely fit within a similarly shaped trapezoidal cavities within the ends of right angle vertical side and top or bottom extrusion at respective corners of said open rectangular frame. The tenons may adhesively join said corner blocks to said extrusions at tenon and mortise connections formed at facing ends of vertical side extensions and said horizontal top and bottom extrusions, respectively.

Preferably, a plurality of oblique edge-to-edge abutting stacked refurbishing panels are fixedly coupled together by right angle, oriented hanger brackets, stapled or otherwise affixed to rear surfaces of the particle board or the vertical side extrusion of respective stacked refurbishing panels to form refurbishing panel assemblies. One or more strips may be fixed to edge abutting refurbishing panels, bridging opposite sides of the edge abutting refurbishing panel and extending parallel to and laterally spaced from the hanger brackets to give added rigidity to the refurbishing panel assemblies and to maintain the edge-to-edge contact of respective stacked refurbishing panels of each panel assembly.

BRIEF DESCRIPTION OF THE DRAWINGS

FIG. 3 is a vertical sectional view of the refurbishing panel assembly of FIG. 2, taken about line 3—3;

FIG. 4 is a horizontal sectional view of the refurbishing panel assembly of FIG. 2, and a portion of the existing space divider partition wall panel showing the nature of the hanger bracket attachment thereto;

FIG. 5 is a perspective view of one of the refurbishing panels of the present invention illustrating the assembly of the extrusions for the refurbishing panel frame in edge abutment with a rectangular sound insulation board forming a core component of the panel;

FIG. 6 is an enlarged perspective view. partially broken away, of a corner block connecting two extrusions to form a portion of the refurbishing panel frame of FIG. 5;

FIG. 7 is a rear elevational view of the refurbishing panel assembly of FIG. 3;

FIG. 8 is an enlarged elevational view of a portion of a refurbishing panel prior to attachment of the fabric cover and connection of a vertical side extrusion to the corner block thereof; and FIG. 9 is a vertical sectional view of the refurbishing panel of FIG. 8, taken about line 9—9.

DESCRIPTION OF THE PREFERRED EMBODIMENT

Figure 1:
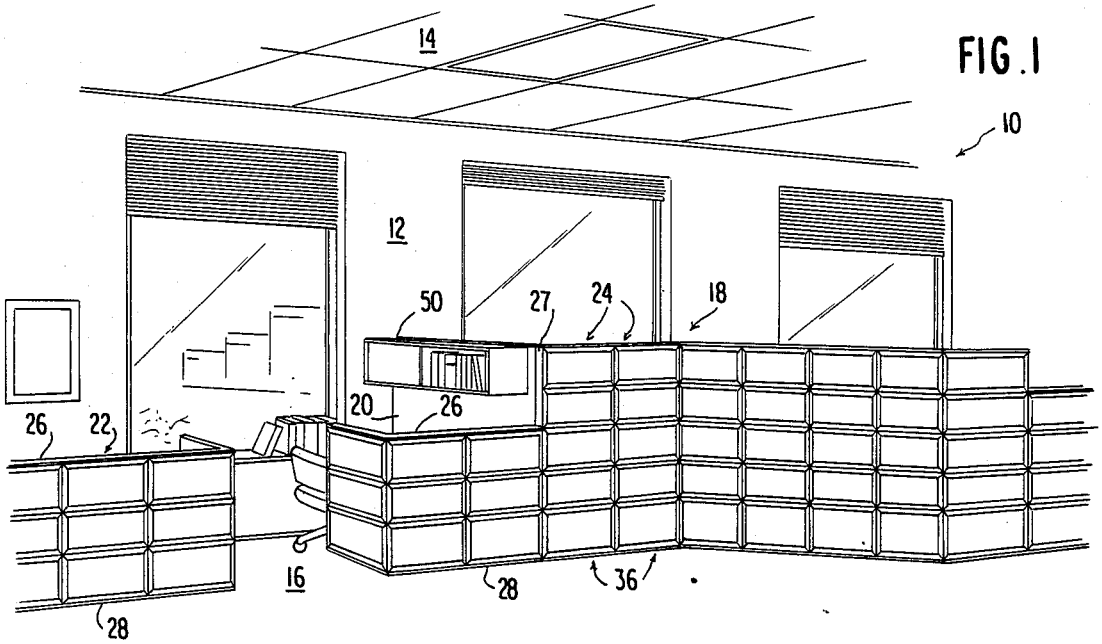
FIG. 1 is a perspective view of an office layout illustrating one embodiment of the refurbishing panel system of the present invention as applied to selective space divider partition walls of a modular office furniture arrangement.

Referring to the drawings, FIG. 1 illustrates a preferred embodiment of the present invention as applied to an existing space divider partition system for modular office furniture. An office indicated generally at 10, is provided with a space defined partially by a vertical exterior wall 12, ceiling 14, and floor 16. The existing space divider partition system 18 is composed of a plurality of vertically oriented space divider partition panels 20. In this case only the panel 20 which supports a cabinet 50 is clearly shown in FIG. 1.

Such existing space divider partition system is well known, and U.S. Pat. Nos. 3,802,146, 3,844,079, 3,862,524, 3,916,972, 4,134,775, 4,144,924, 4,230,900 and 4,376,561 commonly assigned to Steel Case, Inc. of Grand Rapids, Mich. are exemplary of the art to which the present invention constitutes an improvement. Such space divider partition panel 20 is supported by at least two vertical framing members or supports at opposite lateral ends thereof, and have integrated thereto or covered thereby decorative top trim strips 26. decorative side trim strips 27 and decorative bottom trim strips 28. The space divider partition panels 20 may be formed of metal, supporting on opposite faces thereof rectangular boards of generally planar form, made of a sound insulation material such as fiber board, particle board. non-woven fiberglass, etc.

The present invention consists of direct face mounting of refurbishing panel assemblies, as indicated generally at 36, vertically against front and/or rear walls of space divider partition panels 20 of the existing space divider partition system 18.

Figure 2:
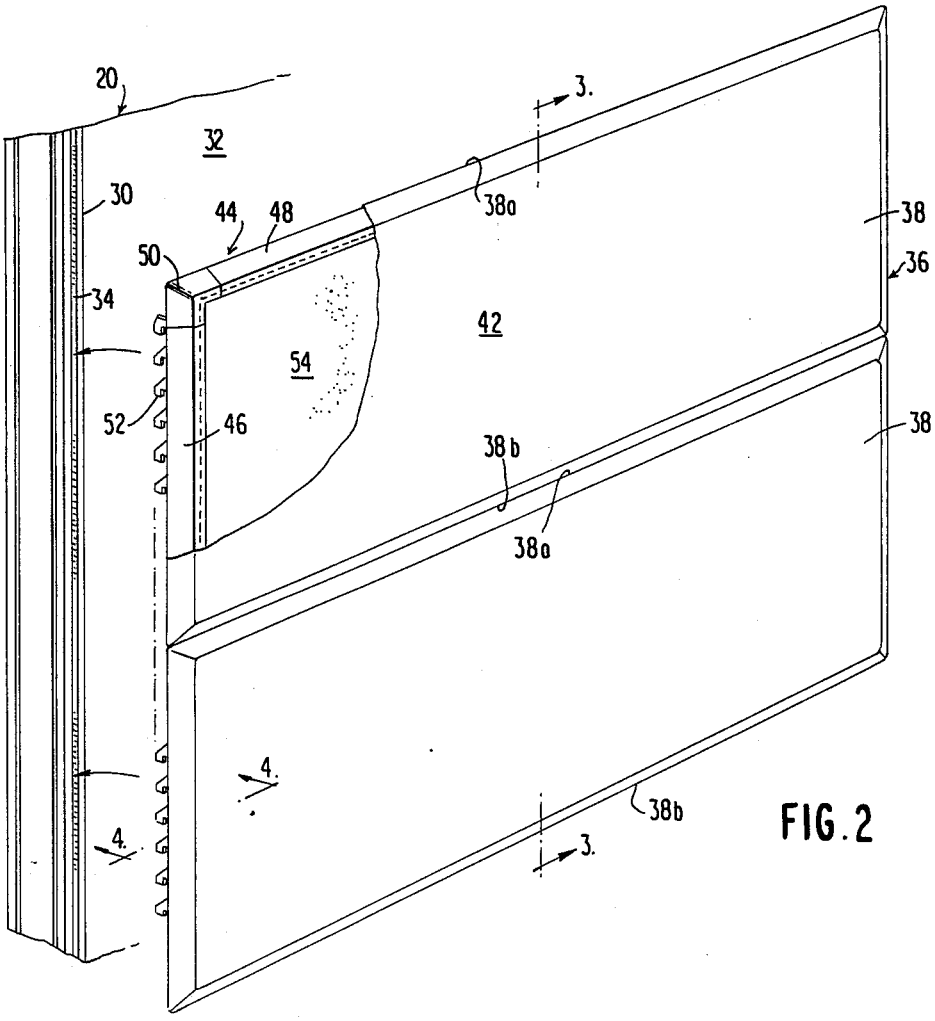
FIG. 2 is an exploded perspective view, partially broken away, illustrating the manner of mounting and dismounting of a refurbishing panel assembly to an existing space divider partition wall panel utilizing the improved hanger brackets forming a preferred embodiment of the present invention.

In turn, each refurbishing panel assembly 36 comprises as a principal components, plural rectangular refurbishing panels, indicated generally at 38. Two panels 38 are shown in FIG. 2 as forming a refurbishing panel assembly 36 for mounting to the front face 32 of an existing space divider partition panel 20. In order to attach the refurbishing panel assembly 36 to the front face of the space divider partition panel 20, the space divider partition panel 10 includes at the end of panel 20, as shown in FIGS. 1 and 4, a vertical channel member or end piece 30, which may be a metal extrusion, provided with a vertical groove 34 over the full vertical length of the same between two flanged portions extending outwardly from a right angle rear wall 124. Wall 124 is provided at vertically spaced locations with vertically elongated slots 126. FIG. 4, so as to receive hooks of a hanger bracket indicated generally at 52, FIG. 2. The hooks thereof fit, respectively, into the elongated vertical slots 126 to detachably mount the refurbishing panel assembly 36 over the vertical front wall of the space divider partition panel 20 to cover or hide soiled, worn or damaged fabric covered space divider partition panels 20.

As further seen in FIG. 2, in the broken away portion of the upper refurbishing panel 38, each panel 38 is formed principally by light weight, plastic extrusions, including identical, mirror image positioned, top and bottom horizontal extrusions 48, and oppositely facing, mirror image positioned. vertical extrusions 46. The ends of the extrusions 48, 46 are coupled together at the four corners by way of corner blocks 50, also preferably molded of light weight plastic. The extrusions 44, 48 and corner blocks 50 are joined by adhesive to form a rigid exterior, rectangular frame for each of the refurbishing panels 38, the adhesive joining of these elements together best seen in FIG. 5, The extrusions and the corner blocks encompass and frame a rectangular sound absorbing material fiberboard 54, preferably a relatively high density matte of random length fiberglass strands. The mounting of the panel refurbishing panel assembly 36 may be seen by the arrows (FIG. 2) as will be explained hereinafter. A sheet of woven fabric 42 covers the front of each frame 44 and fiberboard 54, and is stretched taut over the same. A suitable adhesive such as an epoxy based adhesive may be applied to the peripheral edge 42*a* of the sheet of fabric 42, which adhesively bonds the peripheral edge 42*a* to the rear face of the extrusions 46, 48 and corner blocks 50.

As may be appreciated by reference to FIGS. 1 and 2, the outer peripheral face of the frame 44, as defined by extrusions 46, 48 and blocks 50, is oblique rearwardly and outwardly to provide a smooth tapered edge about each of the panels 38. As a result, V-grooves are formed between confronting edges of respective panels 38, both top to bottom and side to side. A refurbishing panel assembly may, for example, have two-panels 36. FIG. 2, or constitute three-panel assemblies (for a partition wall section 22, FIG. 1), or five-panel vertical refurbishing panel assemblies (for partition wall section 24, FIG. 1).

The make up of both the refurbishing panel assemblies such as assembly 36. FIG. 2, and the individual refurbishing panels 38 making up those assemblies may be further appreciated from the more detailed drawing FIGS. 3–9, inclusive, FIG. 3 provides an excellent view of the positioning and locking of the fiberglass matte board 54 within the frame 44. In creating that assembly between the frame 44 and the fiberboard 54 prior to application of the fabric cover 42 as a light weight, relatively rigid and strong assembly, reference to the drawing shows the nature and the cross-sectional configuration of the extrusions 46, 48 made of common plastic extrusion stock. The corner blocks 50 compliment and interfit those extrusion sections together and about fiberboard 54. FIG. 4 is a horizontal sectional view taken about line 3—3 of FIG. 2, through framed vertical extrusion 46; however, the same cross-section is employed in the horizontal extrusions 48. FIG. 3.

Referring to FIG. 3, the refurbishing panel assembly 36 illustrates the nature by which the confronting upper horizontal edge 38*a* of the lower refurbishing panel 38 abuts the lower edge 38*b* of the upper refurbishing panel 38. Further, FIG. 3 illustrates the nature of the mechanical connection effected between the two panels 38 by means of a coupling strip 60 spanning across the gap between lower edge of the upper panel 38 and the upper edge of the lower panel 38, and being affixed to respective panels 38 by staples 62 to maintain horizontal edge-to-edge contact between the parallel vertically aligned panels 38. This strip 60 may be further seen in FIG. 7, which illustrates the confronting upper horizontal edges 38*a* of the lower panel 38 and the lower horizontal edge 38*b* of the upper panel 38. The strip 60 may be of plastic and may be rigid or semi-rigid. If necessary or appropriate, depending upon the lateral width of the panels 38, several laterally spaced strips 60 may be employed for mechanically locking the rear of two adjacent panels 38 together, along abutting edges 38*a*, 38*b*. It is noted in FIGS. 3 and 7 that the staples 62 are coupled to horizontal frame extrusions 48; however, the strip 60 could be extended and also be stapled to the rear surfaces of the fiberboards 54 of respective panels 38.

Additionally, by viewing FIGS. 3 and 7, the nature, make up, location and mounting of the hanger brackets 52 may be appreciated. Each hanger bracket 52 is formed of angle stock, preferably of extruded plastic such as polyvinylchloride (PVC). The angle bars are provided with right angle portions, one of which constitutes a base as at 64. and the other of which constitutes a right angle outwardly and rearwardly projecting leg 66. The flat outer surface or edge 70, remote from the base 64, of leg 66 carries a series of longitudinally spaced notches or recesses 67 of modified L-shaped configuration, defining therebetween downward and outwardly projecting hooks 68 with the hanger brackets oriented vertically upright as in use. Outer flat edge or surface 70 parallels base 64 of the angle bar extrusion. The notches or recesses 67 are defined by an oblique, upwardly and inwardly directed surface 72 from the outer flat surface 70 to a second flat, vertical inner edge or surface 74. Flat vertical inner edge 74 extends longitudinally beyond lower, right angle, inwardly directed edge 76 of the adjacent hook 68. Further, a narrowed downwardly diverging portion of the groove 82 is formed by the second flat edge 74, a right angle, horizontal end face 80, FIG. 3, and an oblique surface or face 78 joining horizontal right angle faces 76, 80. As may be appreciated, the inner, second flat, surface 74 of the notch or recess 67 defines with oblique face 78 of the hook an angle $\alpha$ of approximately 15°. The configuration given to the hooks 68 and notches 67 of leg 66 of the hanger bracket 52 is such that during placement of the hooks 68 within slots 126 of channel member 30, after entering within groove 34 within the front wall of the space divider partition panel 20 to which the refurbishing panel assembly 36 is to be mounted (FIG. 4), portion 82, of the flared hook recess or notch 67 locks onto the rear wall 124 of the channel member 30 (FIG. 4) at each slot 126 location to securely fasten the refurbishing panel assembly 36 onto the front face of the space divider partition panel 20. Further, when the refurbishing panel assembly 36 is removed from the existing space divider partition wall, the vertical raising of the assembly 36 (FIGS. 3, 4) results in the oblique surfaces 72 of the hanger bracket 52 camming against the upper edge of each slot 126, thereby forcing the assembly 36 (FIGS. 3, 4) to move outwardly, away from the space divider partition panel 20 (FIG. 4).

FIGS. 3, 4 and 7, show the nature in which the fabric cover or sheet 42 for each refurbishing panel 38 is stretched and maintained in place. The fabric cover 42 for each panel is sized in excess to surface area the fiber panel 54 and its frame 44. such that the peripheral edges 42*a* of the fabric sheet 42 are wrapped about to contact rear surfaces of the panels 38. The rear faces of board edge confronting frame members 46, 48, as seen in FIGS. 3 and 4, may be provided with adhesive and the fabric 42 when drawn taut is wrapped about beads 106*a* of the extrusion 46, 48 and is maintained taut by the resilience of those beads 106*a*. Alternatively or additionally staples, such as staples 62 for plastic strip 60, may be employed for fixing the peripheral edges 42*a* of the covering fabric sheets 42 to the frame extrusions 46, 48, as well as corner blocks 50 of frame 44.

In order to create the refurbishing panel assemblies 36 as seen in FIGS. 2, 3 and 7, the frame 44 is formed by extrusions 46, 48 and the corner blocks 50, with these components fixed together by suitable adhesive such as an epoxy adhesive or the like. FIG. 4 illustrates the cross-sectional configuration of extrusion 46, which is the same for extrusion 48, comparing FIGS. 3 and 4. The extrusions 46, 48, in cross-section, include a base or rear wall 100, joined to a much shorter length, parallel front wall 104 by a right angle integral inner end wall 102. The front wall 104 is integrally joined to rear wall 100 by an oblique outer end wall 106 which extends beyond the rear wall 100 and terminates in a near reversely bent extending portion or bead 106*a*. Walls 100, 102, 104 and 106 define a modified trapezoid shaped cavity 122. Further, front wall 104 and rear wall 100 each have a free end 104*a*, 100*a*, respectively, which form, with inner end wall 102, an elongated groove 124 of rectangular cross-section, facing away from oblique, outer end wall 106. Groove 124 receives the peripheral edge 54*a* of the fiber board 54 during assembly, as seen in FIG. 5.

The trapezoidal cavity 122 within the extrusion is purposely formed so as to facilitate a quick and effective adhesive coupling to corner block 50 via tenons 86 thereof. Referring next to FIGS. 6. 8 and 9, the corner block 50 is of molded plastic. Again, that plastic may be polyvinylchloride (PVC). Each corner block is of generally L-shaped plan configuration when viewed from the front face 120, including a central section defined by two intersecting right angle portions 84 which include right angle, outwardly oblique walls 116 meeting a gently rounded corner 118. The hollow block 50 has internal walls 114 which cross at 115, as seen in the bottom plan view, FIG. 8. The bottom of each corner block is thus open at 110 (FIG. 6). Walls 114 extend beyond crossings 115 to join integrally with outer oblique or tapered walls 116. The opposite ends of the central section right angle portions 84 are partially closed by walls 112. Further, tenons, indicated generally at 86, extend outwardly parallel to and projecting from right angle portions 84 of block 50 and are of similar trapezoidal cross-section to that of the corner block central section 83. Each includes an oblique outer wall 92, a front wall 94 and an integral, inner end wall 88 at right angles to front wall 94. The tenons 86 are sized and configured to very closely fit within respective cavities 122 of the extrusions 46, 48, as seen in FIG. 5 and FIG. 9 to form a classic tenon and mortise joint. A coating of adhesive is applied to the tenons 86 prior to insertion of those projections into the extrusion cavities 122 as illustrated in FIG. 5 to effect the fixing of a completed rectangular open frame 44 about the peripheral edge 54*a* of fiberboard 54.

While an embodiment of the invention has been described in detail, it will be evident to those skilled in the art that the invention may be embodied otherwise without departing from its spirit and scope.

What is claimed is:

1. A refurbishing panel assembly for face attachment to an existing space divider partition wall including spaced parallel recessed hanger support means accessible through parallel openings in said partition wall, said refurbishing panel assembly comprising a plurality of edge abutting refurbishing panels, each refurbishing panel comprising: an open rectangular frame including horizontal top and bottom extrusions, laterally opposed vertical side extrusions and molded corner blocks fixedly coupling respective ends of the extrusions and forming an open rectangular frame, said extrusions being identical in cross-section, including a flat, rear wall, an outer flat, parallel front wall integrally joined to the rear wall by a right angle inner end wall, an integral outer end wall extending from said front wall at least to said rear wall and obliquely away from the inner end wall and defining with said front wall, rear and inner end wall a trapazoidal shaped cavity therebetween, the front and rear walls of said extrusions having free end portions extending beyond the inner end wall to the side remote from the outer end wall and forming an inner peripheral groove, a rectangular plan configured board sized to said open frame and having peripheral edges captured within respective inner peripheral grooves of said extrusions, a fabric sheet covering the front face of the board and having peripheral edges thereof wrapped about the oblique outer wall of the extrusions and fixed to the rear wall of the frame extrusions, thereby forming a lightweight refurbishing panel having obliquely tapered edges about the sides thereof, the overall width of the refurbishing panel being equal to the lateral width of the space divider partition wall to be covered, hanger means fixedly mounted to the rear of the multiple refurbishing panels of said refurbishing panel assembly and extending commonly between said multiple refurbishing panels at positions corresponding to said recessed hanger support means, and including hooks projectable through said openings in said partition wall for commonly supporting said refurbishing panels of said refurbishing panel assembly in facing contact with and overlying a surface of said space divider partition wall.

2. The refurbishing panel assembly as claimed in claim 1, wherein said hanger support means comprises a hanger strip having a plurality of longitudinally spaced elongated slots therein. wherein said hanger means commonly mounted to the rear of the refurbishing panels comprises elongated angle bar hanger brackets. each bracket including a flat base fixed commonly to the rear of edge abutting refurbishing panels. a right angle leg having a flat outer surface remote from the base and extending parallel thereto, said right angle leg being serrated along said flat outer surface to form a series of longitudinally spaced notches of modified L-shaped configuration defining a series of said hooks longitudinally spaced from each other, said hooks each including a first flat outer surface parallel to the base a first oblique surface extending inwardly from the first flat outer surface from one hook toward the adjacent hook. to one side of said flat outer surface portion of said hook, a right angle hook end surface to the opposite side thereof, a second flat inner surface extending parallel to the first flat outer surface, from the oblique surface of said one hook to a point beyond the right angle surface of the adjacent hook, a second oblique surface facing said second flat inner surface, and terminating in a notched end face at right angles to the second flat outer surface and extending from said second, flat surface to said second oblique surface and defining therewith an outwardly diverging notch portion, diverging in the direction of said first oblique surface of said angle bar bracket hook, such that the hooks formed thereby frictionally lock to the hanger bracket when inserted within respective elongated slots of said hanger strip, and wherein said first oblique surface of each hook functions to cam the hanger bracket and refurbishing panels supported thereby outwardly of said existing space divider partition wall opening to facilitate removal of the refurbishing panel assembly therefrom upon vertical lifting of the refurbishing panel assembly from the space divider partition wall.

3. The refurbishing panel assembly as claimed in claim 1, further comprising coupling strips spanning across abutting edges of respective refurbishing panels intermediate of said hanger brackets and being fixedly mounted to frame extrusions of respective refurbishing panels proximate to the abutting edges of respective panels for maintaining said plurality of refurbishing panels in edge abutting positions, and forming a relatively rigid refurbishing panel assembly.

4. The refurbishing panel assembly as claimed in claim 2, further comprising coupling strips spanning across abutting edges of respective refurbishing panels intermediate of said hanger brackets and being fixedly mounted to frame extrusions of respective refurbishing panels proximate to the abutting edges of respective panels for maintaining said plurality of refurbishing panels in edge abutting positions. and forming a relatively rigid refurbishing panel assembly.

5. The refurbishing panel assembly as claimed in claim 1, wherein each refurbishing panel is formed by end-to-end right angle positioned lightweight, plastic extrusions in oppositely facing, mirror image position, each extrusion being coupled at opposite sides to an adjacent, right angle end of a lightweight, molded plastic corner block.

6. The refurbishing panel assembly as claimed in claim 2, wherein each refurbishing panel is formed by end-to-end right angle positioned lightweight, plastic extrusions in oppositely facing, mirror image position, each extrusion being coupled at opposite sides to an adjacent, right angle end of a lightweight, molded plastic corner block.

7. The refurbishing panel assembly as claimed in claim 3, wherein each refurbishing panel is formed by end-to-end right angle positioned lightweight, plastic extrusions in oppositely facing, mirror image position, each extrusion being coupled at opposite sides to an adjacent, right angle end of a lightweight, molded plastic corner block.

8. The refurbishing panel assembly as claimed in claim 5, wherein said corner blocks are of generally L-shaped plan configuration, have outwardly oblique right angle faces extending from a flat front face thereof toward a rear face thereof, and form a central section and tenons of complimentary plan configuration integral with said central section. and projecting outwardly thereof at right angles to each other from opposite end faces of the corner block central section, said corner block tenons being of trapezoidal cross-sectional configuration sized to and closely fitted within said trapezoidal shaped cavities within the ends of the right angle extrusion at respective corners of said open rectangular frame.

9. The refurbishing panel assembly as claimed in claim 1, wherein said oblique outer end wall of each extrusion extends beyond the rear wall thereof and terminates in a near reversely bent bead, and said fabric sheet wraps at the periphery thereof about said bead of each extrusion to resiliently maintain the fabric stretched taut about four sides of the panel open rectangular frame.

10. The refurbishing panel assembly as claimed in claim 5, wherein said oblique outer end wall of each extrusion extends beyond the rear wall thereof and terminates in a near reversely bent bead, and said fabric sheet wraps at the periphery thereof about said bead of each extrusion to resiliently maintain the fabric stretched taut about four sides of the panel open rectangular frame.

11. The refurbishing panel assembly as claimed in claim 8, wherein said oblique outer end wall of each extrusion extends beyond the rear wall thereof and terminates in a near reversely bent bead, and said fabric sheet wraps at the periphery thereof about said bead of each extrusion to resiliently maintain the fabric stretched taut about four sides of the panel open rectangular frame.

12. A refurbishing panel for attachment to an existing space divider partition wall in facing contact with a flat surface of the space divider partition wall for covering that flat surface, said refurbishing panel comprising an open rectangular frame, including horizontal top and bottom extrusions, laterally opposed vertical side extrusions and molded corner blocks fixedly coupling respective ends of the extrusions and forming an open frame, said extrusions being identical in cross-section, including a flat, rear wall, an outer flat parallel front wall integrally joined to the rear wall by a right angle inner end wall, an integral outer end wall extending from said front wall at least to said rear wall and obliquely from the inner end wall and defining with said rear wall, said front wall and said inner end wall, a trapazoidal shaped cavity therebetween, the front and rear walls of said extrusions having free end portions extending beyond the inner end wall to the side remote from the outer end wall and forming an inner peripheral groove, a rectangular plan configured board sized to said open frame and having peripheral edges captured within respective inner peripheral grooves of said extrusions, a fabric sheet covering the front face of the board and having peripheral edges thereof wrapped about the oblique outer wall of the extrusions and fixed to the rear wall of the frame extrusions, thereby forming a lightweight refurbishing panel having obliquely tapered edges about the sides thereof, with the overall width of the refurbishing panel being equal to the lateral width of the space divider partition wall to be covered.

13. The refurbishing panel as claimed in claim 12, wherein said top, bottom and side extrusions are, end-to-end right angle positioned lightedweight, plastic extrusions in oppositely facing, mirror image position, and wherein each plastic extrusion is coupled at opposite ends to an adjacent, right angle end of a lightweight, molded plastic corner block.

14. The refurbishing panel as claimed in claim 13, wherein said corner blocks are of generally L-shaped plan configuration having outwardly oblique right angle faces extending from a flat front face thereof toward a rear face thereof and forming a central section and tenons of complimentary plan configuration integral with said central section and projecting outwardly thereof at right angles to each other from opposite end faces of the corner block central section, said corner block tenons being of trapazoidal cross-sectional configuration sized to and closely fitted within said trapazoidal shaped cavity with the ends of the right angle positioned, lightweight plastic extrusion at respective corners of said open rectangular frame.

15. The refurbishing panel as claimed in claim 14, wherein said oblique outer end wall of each extrusion extends beyond the rear wall thereof, and terminates in a near reversely bent bead, and said fabric sheet wraps at the periphery thereof about said bead of each extrusion to resiliently maintain the fabric stretched taut about the four sides of the panel open rectangular frame.

* * * * *